United States Patent [19]

Muiza et al.

[11] Patent Number: 4,742,838

[45] Date of Patent: May 10, 1988

[54] WALKER

[76] Inventors: Andrejs Muiza, 1811 Sweetbriar Ave., Nashville, Tenn. 37212; Albert H. Valiquette, 3411 Richard Street, Nashville, Tenn. 37215

[21] Appl. No.: 911,385

[22] Filed: Sep. 25, 1986

[51] Int. Cl.[4] ..... A61H 3/00

[52] U.S. Cl. ..... 135/67

[58] Field of Search ..... 135/67, 68, 69, 85; 272/70, 70.1, 70.2, 70.3; 297/455; 280/79, 79.1 R, 109, 110

[56] References Cited

U.S. PATENT DOCUMENTS 2,656,874 10/1953 Robb ..... 135/67
2,738,830 3/1956 Black ..... 135/67
3,165,112 1/1965 Ries ..... 135/67
3,517,677 6/1970 Smith ..... 135/67

*Primary Examiner*—Robert A. Hafer
*Assistant Examiner*—Charles H. Sam
*Attorney, Agent, or Firm*—Harrington A. Lackey

[57] ABSTRACT

A walker having a rigid main frame including front and side frame portions, depending rear legs and a pair of hand holds on the upper portion of the main frame, a front frame member including a pair of front legs journaled to the front portion of the main frame for forward and rearward swinging movement relative to the main frame, a spring member on the main frame normally urging the front legs to a forward extended position, and guide members to limit the swinging movement of the front legs.

9 Claims, 2 Drawing Sheets

3
3

WALKER

BACKGROUND OF THE INVENTION

This invention relates to a walker for use in assisting a person, such as an invalid, to walk, and more particularly to a walker of the type having relatively movable front and rear legs.

Most walkers utilized in assisting invalids to walk comprise a rigid frame-like structure having four well spaced legs with hand holds at the top thereof for gripping by the invalid. In the use of such walkers, the invalid must first lift the entire frame above the floor, move it forward, and lower the frame to engage the floor again before taking a forward step. The height of the lifting motion is dependent upon the contour of the ground surface and the existence of any obstacles upon the ground or floor surface. In many instances, the invalid tends to slide a rigid frame-type walker along the floor where the floor is relatively level or smooth and no obstacles exist. In either event, excessive energy is utilized by the invalid, who may be already in a weakened condition, for the sole effort of moving the walker each time a walking step is executed.

Attempts have been made to overcome the above disadvantages of the rigid type walker by utilizing a frame structure in which the rear legs of the walker are pivotally movable relative to the front legs. Examples of some of these walkers are shown in the following patents:

| | | |
|---|---|---|
| | U.S. Pat. Nos. | |
| 2,656,874 | Robb | Oct. 27, 1953 |
| 2,738,830 | Black | Mar. 20, 1956 |
| 2,855,024 | Robb | Oct. 7, 1958 |
| 3,165,112 | Ries | Jan. 12, 1965 |
| 3,199,521 | Ries | Aug. 10, 1965 |
| | FOREIGN PATENTS | |
| 722,942 (British) | | Feb. 2, 1955 |
| 1,105,324 (French) | | Nov. 29, 1955 |

All of the above patents disclose various types of walkers permitting relative limited pivotal movement between the front and rear leg members in a walking action.

Each of the above patents discloses a walker in which the handle or handle members are rigidly connected to the front legs or leg members so that the handle member can be utilized to thrust the front leg members forward relative to the rear leg member.

Both Robb patents, the Black patent and the British patent disclose spring members connecting the front and rear leg members to bias the rear leg members toward the front leg members when the walker frame is tilted forward.

Both Ries patents and the French patent do not include springs, but rely upon gravity to permit the rear leg members to be drawn toward the front leg members when the front frame is tilted forward.

Thus, all of the above cited patents disclose walkers having front and rear leg member relatively movable toward and away from each other, but in every case, the biasing means is designed to bias the rear legs forward toward the front frame. Such action, that is the movement of the frame forward with the front legs on the ground or floor by the invalid to disengage the rear legs from the ground or floor can be dangerous, if the frame is tilted too far forwardly, such as in the event the rear legs have to be raised high enough to clear an obstacle.

Moreover, an unnecessary effort is required on the part of the invalid for pushing down upon the handle member in order to pivot the front frame, including the front legs about the pivot point, such as illustrated in the Black and Robb patents, for moving the front legs forward the necessary increment to effect the walking step. Moreover, in this pivotal action of moving the front frame and legs forward, the invalid is operating against the retracting force of the biasing or spring member.

The fact that seven patents, including five U.S. patents, have been granted for walkers having relatively swinging rear and front legs is indicative of the fact that the ordinary skill in the art is low.

SUMMARY OF THE INVENTION

It is therefore an object of this invention to provide a walker, particularly for use by an invalid, having a frame structure in which the front legs are adapted to swing forward and rearward through a limited distance relative to the main frame and the rear legs of the walker.

The walker made in accordance with this invention includes a main or base frame having front and side portions, and rear legs rigid with respect to the main frame projecting downward and rearward. A pair of hand holds are provided on the upper portion of the main frame. A front frame member incorporating a pair of forward depending front legs is journaled upon the main frame for forward and rearward swinging movement, and the front legs are provided with slotted guide members for receiving stop arms rigid with respect to the main frame in order to limit the forward and rearward travel of the front legs.

The main frame includes a front transverse frame member supporting a spring member, preferably a leaf spring member, biased to urge the front legs forward to a normal extended positioned.

The walker made in accordance with this invention is designed to be initially placed with all four legs on the floor or ground supporting surface with the front legs in their forward extended position. By slightly lifting the rear legs from the ground supporting surface and moving the main frame forward, the spring member is compressed while the front legs remain fixed on the supporting surface. The rear legs are then lowered to engage the grounding supporting surface and the main frame lifted slightly causing the front legs to automatically swing forward in response to the biasing action of the spring member. The operation is then repeated.

The action of the walking movement with the walker made in accordance with this invention is smoother and requires less unnecessary exertion on the part of the invalid. The initial effort of the invalid or operator in raising the rear legs is about the only positive effort required by the invalid. After the rear legs are raised, the invalid begins walking forward and the weight of his body down upon the hand holds will cause the rear frame to move toward the stationary front legs and compress the spring. When the legs are fully contracted, the operator lowers the rear legs and the front legs automatically extend forward under the slightest release of pressure upon the main frame, and with only the slightest possible lifting movement upon the main frame.

Other features of this invention are the utilization of a single elongated leaf spring mounted on the main frame so that the leaf spring engages and urges forward both front legs.

Another advantage of this invention is the unique frame structure in which side single frame members are utilized to form the rear legs, hand holds and depending stop arms, and another single frame member is formed to provide a front transverse frame member, a pair of depending reinforcing vertical leg portions, and rearwardly extending reinforcing side frame struts.

DESCRIPTION OF THE PREFERRED EMBODIMENT

Figure 1:
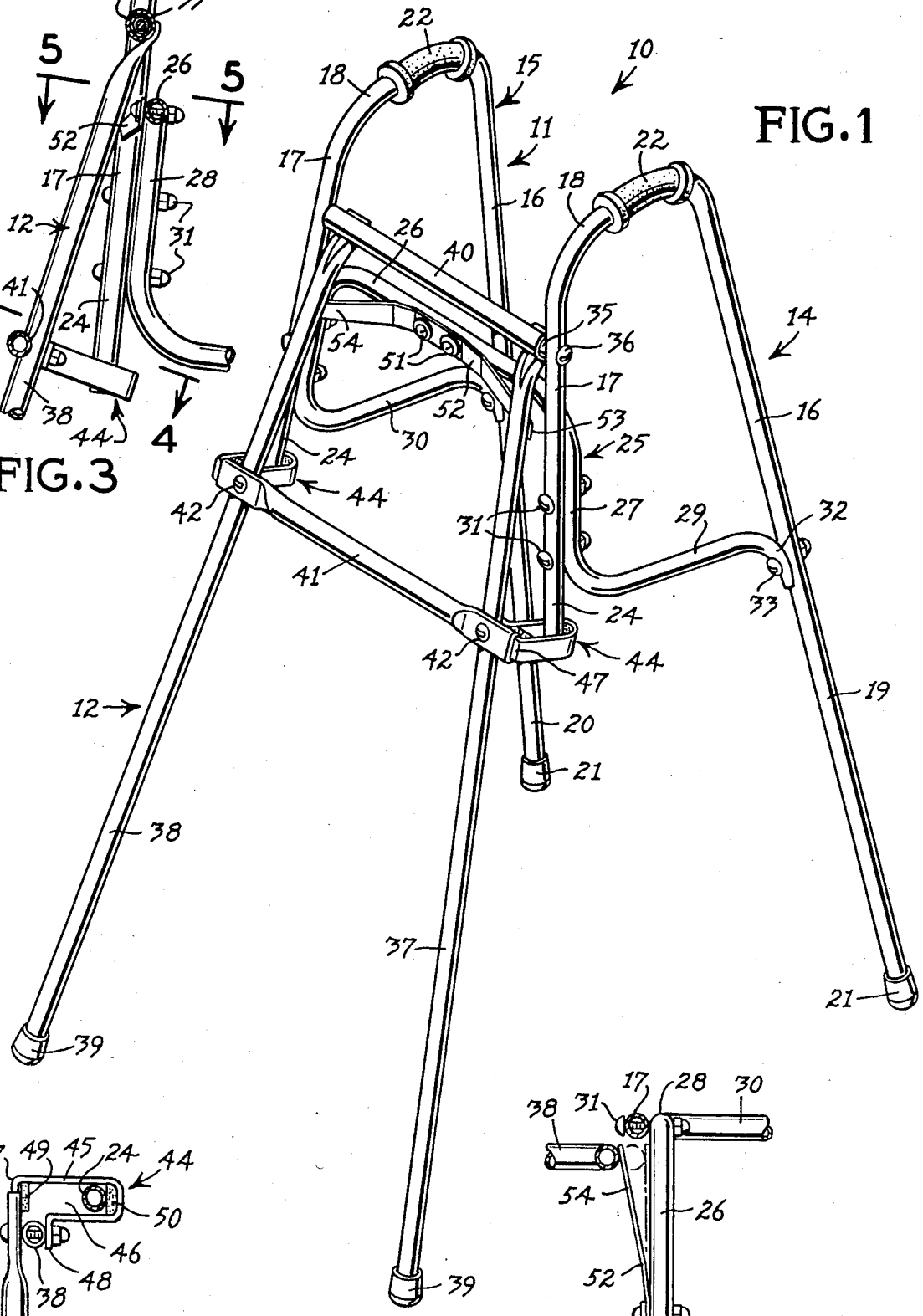
FIG. 1 is a front and side perspective view of the walker made in accordance with this invention, in which the front legs are extended.

Referring now to the drawings in more detail, FIG. 1 discloses a walker 10 made in accordance with this invention, including a main or base frame 11 and a front frame member 12 adapted to have limited forward and rearward swinging movement relative to the main frame 11. The main frame 11 includes front and rear portions, left and right side portions and upper and lower portions.

The main frame 11 includes a pair of opposed inverted U-shaped side members 14 and 15. Each side member 14 and 15 includes a long leg portion 16, a short leg portion 17, and a connecting bight portion 18, formed from an elongated unitary piece of material, such as tubular steel.

Each long leg portion 16 extends downward to form a corresponding rear leg 19 and 20 terminating in ground engaging end portions, preferably inserted in the resilient feet or cups 21.

Each of the bight portions 18 defines a handle member comprising a hand hold, or hand grip 22. As disclosed in FIGS. 6–8, the hand holds or grips 22 are located closer to the rear than the front of the main frame 11.

Each of the short leg portions 17 depends from the corresponding bight portion 18 and terminates at a substanial elevation above the bottoms of the rear legs 20 and 21 to form substantially upright front frame elements or stop arms 24, the function of which is to be described later.

In order to rigidly secure the two side members 14 and 15 together, a unitary elongated brace member 25 is bent, or otherwise formed, into an overall substantially inverted U-shaped member having a transverse bight portion defining a transverse frame member 26, a pair of depending upright leg portions 27 and 28 and a pair of rearward projecting leg portions or side struts 29 and 30. The upright leg portions 27 and 28 fit flush against and parallel to the short leg portions 17 of the side frame members 14 and 15, and are rigidly secured to the leg portions 17 by the bolts 31, or other fasteners. In this position, the transverse frame member 26 extends across and between the front short leg portions 17. The rearward projecting side struts 29 and 30 terminate in end portions 32 secured to the corresponding rear legs 19 and 20 by bolts 33, or other fasteners, to reinforce the side portions of the main frame 11.

Therefore, with a minimum of materials and fabrication, the main frame 11, including the rear legs 19 and 20, is rigidly formed by only three elongated unitary members 14, 15, and 25, all of which may be fabricated from tubular steel.

An elongated journal rod or hinge rod 35 extends across and between the upright front leg portions 17 and is rigidly secured to the leg portions 17 by the bolts 36, or other appropriate fasteners. The transverse journal rod 35 also functions as an additional brace or reinforcing member for the main frame 11.

The front frame member 12 includes a pair of opposed front legs 37 and 38, the bottom ends of which are adapted to engage the floor or ground surface and are preferably covered by the resilient feet or cups 39. The upper ends of the front legs 37 and 38 are connected to or integrally formed with a bearing member, such as the bearing sleeve 40 journaled about the hinge or journal rod 35 to permit free pivotal movement of the frame 12 relative to the main frame 11.

The front frame member 12 further includes an elongated transverse brace bar 41 rigidly secured to the front legs 37 and 38 by the bolt fasteners 42, in order to reinforce the front legs 37 and 38 and form a rigid front frame member 12.

Figure 4:
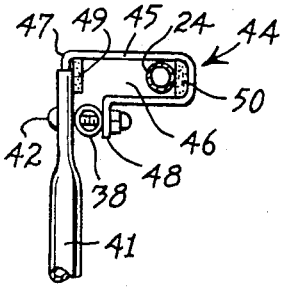
FIG. 4 is a fragmentary section taken along the line 4—4 of FIG. 3.
Figure 5:
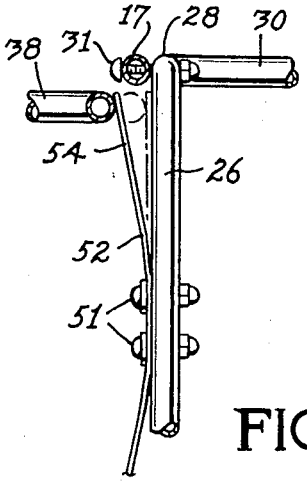
FIG. 5 is a fragmentary section taken along the line 5—5 of FIG. 3, illustrating the leaf spring in two different positions.

Fixed to the corresponding front legs 37 and 38, respectively, are elongated guide members 44, preferably formed from a single piece of metal bent to form the guide walls 45 surrounding an elongated guide slot 46 extending rearwardly from the front frame member 12. The guide members 44 are fixed to the front legs 37 and 38 at a sufficient elevation that the depending stop arms 24 will project downward through the elongated slots 46. In a preferred form of the invention, the guide members 44 are secured to the front legs 37 and 38 by the same bolt fasteners 42 which connect the front brace bar 41 to the front legs 37 and 38. Furthermore, as best illustrated in FIGS. 1 and 4, one end 47 of each guide wall 45 projects into a corresponding end of the front brace bar 41. Preferably, the ends of the brace bar 41 are flattened, so that the fasteners bolts 42 project through the flattened ends of the brace bar 41, the corresponding front legs 37 and 38 and through the opposite bent end 48 of the guide wall 45.

The elongated guide slot 46 is wide enough to just receive the downward projecting stop arm 24 for free relative longitudinal or front-to-rear movement without binding. The length of the elongated guide slot 46 is sufficient to permit the desired front-to-rear travel of the front legs 37 and 38 relative to the main frame 11. The front end of each guide slot 46 may be provided with a front bumper pad 49, while a similar rear bumper pad 50 is secured at the rear end of the elongated slot 46, to cushion the abutment of the stop arm 24 at the opposite ends of the guide slot 46.

Figure 3:
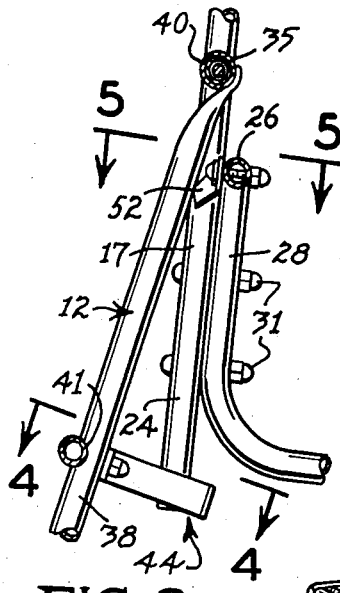
FIG. 3 is an enlarged fragmentary sectional elevation taken along the line 3—3 of FIG. 2.

Fixedly secured to the front surface of the middle of the front transverse frame member 26 by bolt fasteners 51 is an elongated elastic spring member, such as the leaf spring 52, whose end portions 53 and 54 are long enough to extend behind the front legs 37 and 38. The shape and elasticity of the leaf spring 52 are such that the end portions 53 and 54 will be in constant engagement with the rear surfaces of the upper end portions of the front legs 37 and 38. The leaf spring 52 is strong enough that when the front legs 37 and 38 are elevated above the ground engaging surface, the spring 52 will automatically thrust the front legs 37 and 38 forward until the rear bumper pads 50 engage the depending stop arms 24, as illustrated in FIGS. 1, 3, and 4. By moving the main frame 11 toward the front frame member 12, when the front frame member 12 is engaging the ground supporting surface, the stop arms 24 will be moved longitudinally forward along the slots 46 until the arms engage the front bumper pads 49. During this forward movement of the main frame 11, the end portions 53 and 54 of the spring member 52 are compressed by the front legs 37 and 38.

As best illustrated in FIGS. 1 and 6–8, the hand holds or hand grips 22 are located substantially behind the front frame member 12, and closer to the rear legs 19 and 20 than they are to the front legs 37 and 38 or to the front upright leg portions 17. The rearward location of the hand holds 22 tends to prevent the operator or invalid from falling forward when the rear legs 19 and 20 are elevated during the walking process, and also increases the leverage of the hand holds 22 about the pivotal axis of the hinge rod 35.

Figures 2, 6, 7, 8:
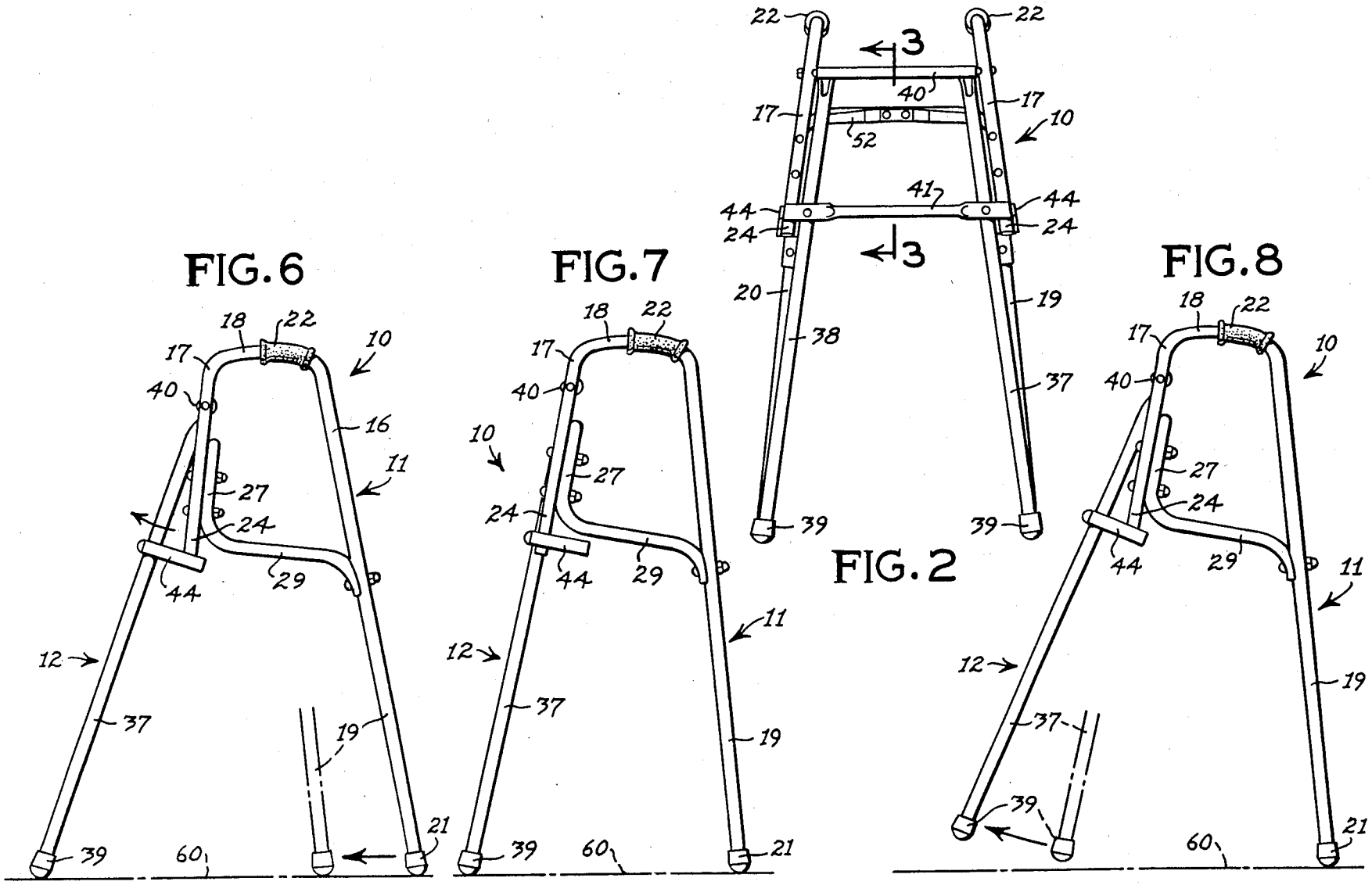
FIG. 2 is a front elevation of the walker disclosed in FIG. 1, to a smaller scale.
FIG. 6 is a left side elevation of the walker disclosed in FIG. 2, with the walker in an initial position, in which the front legs are extended and also illustrating the rear legs in a phantom contracted position.
FIG. 7 is a view similar to FIG. 6 of the walker in a contracted position.
FIG. 8 is a view similar to FIG. 7 in which the front legs of the walker are raised to permit the front legs to swing forward from the contracted phantom position to the solid-line extended position.

In the operation of the walker 10, the operator or invalid, not shown, stands behind the walker 10 in its initial position as disclosed in FIG. 6. The height of the walker 10 is preferably less than the height of the waist of the person using the walker 10. The operator or invalid grips the hand holds or grips 22 with each hand and with a slight upward motion gradually elevates the main frame 11 to disengage the rear feet 21 from the ground or floor 60, while the front legs remain upon the ground or floor. The main frame 12 is urged forward by the operator's hands, so that the rear legs 19 and 20 pivot about the hinge rod 35 and move from their solid-line position in FIG. 6 forward to the phantom position of FIG. 6. Then, when the stop arms 24 have reached the extent of their forward travel within the guide members 44, as illustrated in FIG. 7, the main frame 12 is lowered until the rear feet 21 engage the ground surface 60.

Then, with a very slight rearward tilting movement of the main frame 11, the front legs 37 and 38, become disengaged from the ground surface 60, as illustrated in phantom in FIG. 8, and are immediately and automatically thrust forward to the solid-line position of FIG. 8 by the spring member 52, without any additional effort by the operator or invalid. The front frame member 12 is then lowered until the front feet 39 engage the ground or floor surface 60 so that the walker 10 is then in its original solid-line position disclosed in FIG. 6. The operation is then repeated. For each operative cycle of the walker 10, the operator will take one small step per cycle.

It is therefore apparent that a walker 10 has been designed in which the front legs 37 and 38 are mounted for swinging movement relative to the main frame 11 and in which the front legs are urged forward by the spring member 52. Thus the operator utilizes only a minimum of exertion in lifting and pushing forward the main frame while the front legs are stationary upon the ground. When the front and rear legs are fully contracted, the rear legs are lowered and the front legs automatically and immediately are swung forward to a forward stable position, and the operation repeated.

The walker made in accordance with this invention is also made of a minimal number of structural elements, most of which can be lightweight tubular members, such as stainless steel tubing. Only a single spring member, namely the elongated leaf spring 52 is incorporated for thrusting forward both of the front legs 37 and 38.

The main frame 11 is made of only three elongated bent tubular members, namely the side pieces 14 and 15 and the bent brace member 25.

In a preferred form of the invention, the rear legs 19 and 20 diverge laterally or transversely downward about a central vertical longitudinal plane. Moreover, the front legs 37 and 38 diverge laterally or transversely downward about the same central vertical longitudinal plane, as is apparent in FIG. 2. The downward diverging legs provide additional stability of the walker 10 against lateral or transverse tilting or tipping.

What is claimed is:

1. A walker comprising:

(a) a main frame having upper and lower portions and front and rear portions comprising a pair of side frame members, each said side frame member having a downward projecting ground-engaging rear leg, and a transverse frame member rigidly connecting said side frame members in transverse spaced relationship, each said rear leg being rigid with respect to the other portions of said main frame, (b) a front frame member comprising a pair of downward and forward projecting ground-engaging front legs having upper end portions, (c) means on said upper end portions in pivotal contact with the front portion of said main frame for swinging front-to-rear movement of said front legs about a transverse axis relative to said main frame, (d) guide means cooperative between said front portion of said main frame and said front legs for limiting the swinging movement of said front legs relative to said main frame between a forward extended position and a rearward contracted position, (e) spring means fixed to said front portion of said main frame and cooperating with said front legs to normally bias said front legs forward to said extended position, and (f) hand holds on the upper portion of said main frame.

2. The invention according to claim 1 in which said transverse frame member extends across the front portion of said main frame, said spring means being fixed to said transverse frame member.

3. The invention according to claim 2 in which said spring means comprises an elongated leaf spring having a middle portion and opposite end portions, means fixing the middle portion of said leaf spring to the middle portion of said transverse frame member so that the opposite ends of said leaf spring extend behind and in engagement with said front legs.

4. The invention according to claim 1 in which said means journaling said upper end portions comprises an elongated journal rod fixed transversely in the front portion of said base frame and bearing means connecting said upper end portions for pivotal movement on said journal rod.

5. The invention according to claim 1 in which said guide means comprises a pair of elongated guide members having elongated vertical slots extending front to rear, means fixing said guide members to said corresponding front legs to project rearwardly, a pair of stop arms forming a part of the front portion of said main frame, each stop arm extending vertically through the elongated slot of a corresponding guide member.

6. The invention according to claim 5 in which each of said side frame members comprises an elongated substantially U-shaped member having a short leg portion and a long leg portion joined by a bight portion, each of said long leg portions comprising said rear legs, said short leg portions comprising said stop arms, and said bight portions comprising said hand holds.

7. The invention according to claim 1 in which said side frame members comprise said rear legs and opposed elongated upright front frame elements, an elongated unitary substantially U-shaped brace member having a transverse bight portion, and a pair of depending leg portions terminating in rearward projecting side struts, means securing said side struts to said rear legs, and means securing said depending leg portions parallel to and flush against said front frame elements.

8. The invention according to claim 1 in which said front legs and said rear legs diverge front-to-rear downwardly in both said extended and said contracted positions.

9. The invention according to claim 1 in which said rear legs and said front legs diverge laterally downward.

* * * * *